United States Patent [19]

Wissmann et al.

[11] Patent Number: 4,567,658

[45] Date of Patent: Feb. 4, 1986

[54] SAW CHAIN TENSIONING ARRANGEMENT FOR A CHAIN SAW

[75] Inventors: Michael Wissmann, Markgröningen; Hans Nickel, Cottenweiler; Erich Zöllner, Bietigheim Bissingen, all of Fed. Rep. of Germany

[73] Assignee: Andreas Stihl, Waiblingen, Fed. Rep. of Germany

[21] Appl. No.: 571,476

[22] Filed: Jan. 17, 1984

[30] Foreign Application Priority Data

Jan. 18, 1983 [DE] Fed. Rep. of Germany ..... 3301367

[51] Int. Cl.[4] ..... B27B 17/14

[52] U.S. Cl. ..... 30/386; 83/816

[58] Field of Search ..... 30/386, 387, 370; 83/816, 817; 74/425; 464/32

[56] References Cited

U.S. PATENT DOCUMENTS

| | | | |
|---|---|---|---|
| 2,050,630 | 8/1936 | Reid | 464/32 |
| 2,933,112 | 4/1960 | Bentley | 30/386 X |
| 3,866,320 | 2/1975 | Progl | 30/386 |
| 3,895,700 | 7/1975 | Kerr | 74/425 X |
| 4,382,334 | 5/1983 | Reynolds | 30/386 |

FOREIGN PATENT DOCUMENTS

| | | | |
|---|---|---|---|
| 561719 | 8/1958 | Canada | 30/386 |
| 2042974 | 10/1980 | United Kingdom | 30/386 |

*Primary Examiner*—E. R. Kazenske
*Assistant Examiner*—W. Fridie
*Attorney, Agent, or Firm*—Walter Ottesen

[57] ABSTRACT

The invention is directed to a tensioning arrangement for adjusting the tension in the saw chain of a chain saw. The cutter bar for the saw chain has an elongated opening for engaging the guiding means upon which the cutter bar is displaceably mounted and guided in the housing of the chain saw. The tensioning arrangement includes a bolt-like drive member which extends through the elongated opening of the cutter bar and acts upon an output member via a transmission. The output member is configured as a slider which entrains the cutter bar for displacing the latter to tension the saw chain. The drive member extends through the elongated opening and beyond the housing as well as the cover of the sprocket wheel to the outside so that it can be adjusted conveniently and simply from outside of the housing for tensioning the saw chain.

12 Claims, 4 Drawing Figures

SAW CHAIN TENSIONING ARRANGEMENT FOR A CHAIN SAW

FIELD OF THE INVENTION

The invention relates to an arrangement for conveniently adjusting the tension in the saw chain of a power-driven chain saw.

BACKGROUND OF THE INVENTION

In a known arrangement for tensioning the saw chain of a chain saw, the drive member is a tensioning bolt extending parallel to the cutter bar and the output member is an entrainment bolt extending radially to the shaft of the tensioning bolt. The tensioning bolt is arranged very close to the housing and to the cutter bar of the chain saw so that the head of the bolt is hardly visible from the outside and access thereto is difficult because parts of the chain saw are arranged so close thereto. Therefore, it is not possible or only very difficult to insert a screwdriver in the slot of the bolt to adjust the tension of the saw chain. Furthermore, there is very little room for the operator to position the hand to rotate the screwdriver so that an adjustment is made very difficult and takes a relatively large amount of time to perform.

SUMMARY OF THE INVENTION

It is an object of the invention to provide a tensioning arrangement which permits the operator of the chain saw to adjust the tension of the saw chain quickly and simply. It is a further object of the invention to provide such a tensioning arrangement which is adapted for installation and use with a chain saw having a conventional cutter bar equipped with an elongated or slot-like opening so that this cutter bar and its simple assembly may be retained.

The tensioning arrangement of the invention is for tensioning the saw chain of a power-driven chain saw having a motor housing and a cutter bar for guiding the saw chain. The chain saw further has a drive wheel for moving the saw chain about the periphery of the cutter bar. The tensioning arrangement of the invention includes guiding and mounting means for guidingly mounting the cutter bar on the motor housing. Said guiding and mounting means includes projection means extending from the housing and the cutter bar defines a longitudinal axis and has an elongated opening formed therein for engaging said projection means to guidingly support the cutter bar on the motor housing and to permit movement of the cutter bar with respect to the motor housing in the direction of said longitudinal axis. Drive means are arranged in the region of said elongated opening and output means are arranged adjacent the cutter bar. Transmission means connects said drive means to said output means so as to actuate the latter in response to a movement of said drive means. Finally, entrainment means interconnects said output means with the cutter bar for entraining and moving the cutter bar in the direction of said axis away from the sprocket wheel to increase the tension in the saw chain in response to an adjustment of said drive means.

The drive member in the arrangement of the invention is mounted so that it is brought out through the housing and a sprocket wheel cover mounted on the latter thereby making the drive member freely accessible from outside of the housing for adjusting the tension in the saw chain. In this way, the drive member can be adjusted quickly and with only minimal effort. Furthermore, the drive member is easily visible when assembling the cutter bar and the sprocket wheel cover so that these parts can be simply and quickly assembled without difficult and time consuming alignment work. The conventional cutter bar is equipped with an elongated opening through which the drive member projects so that a special opening does not have to be formed in the cutter bar for accommodating the drive member. In this way, a conventional and standard cutter bar can be used with the tensioning device of the invention.

BRIEF DESCRIPTION OF THE DRAWING

The invention will now be explained with reference to the drawing wherein.

DESCRIPTION OF THE PREFERRED EMBODIMENTS OF THE INVENTION

Figure 1:
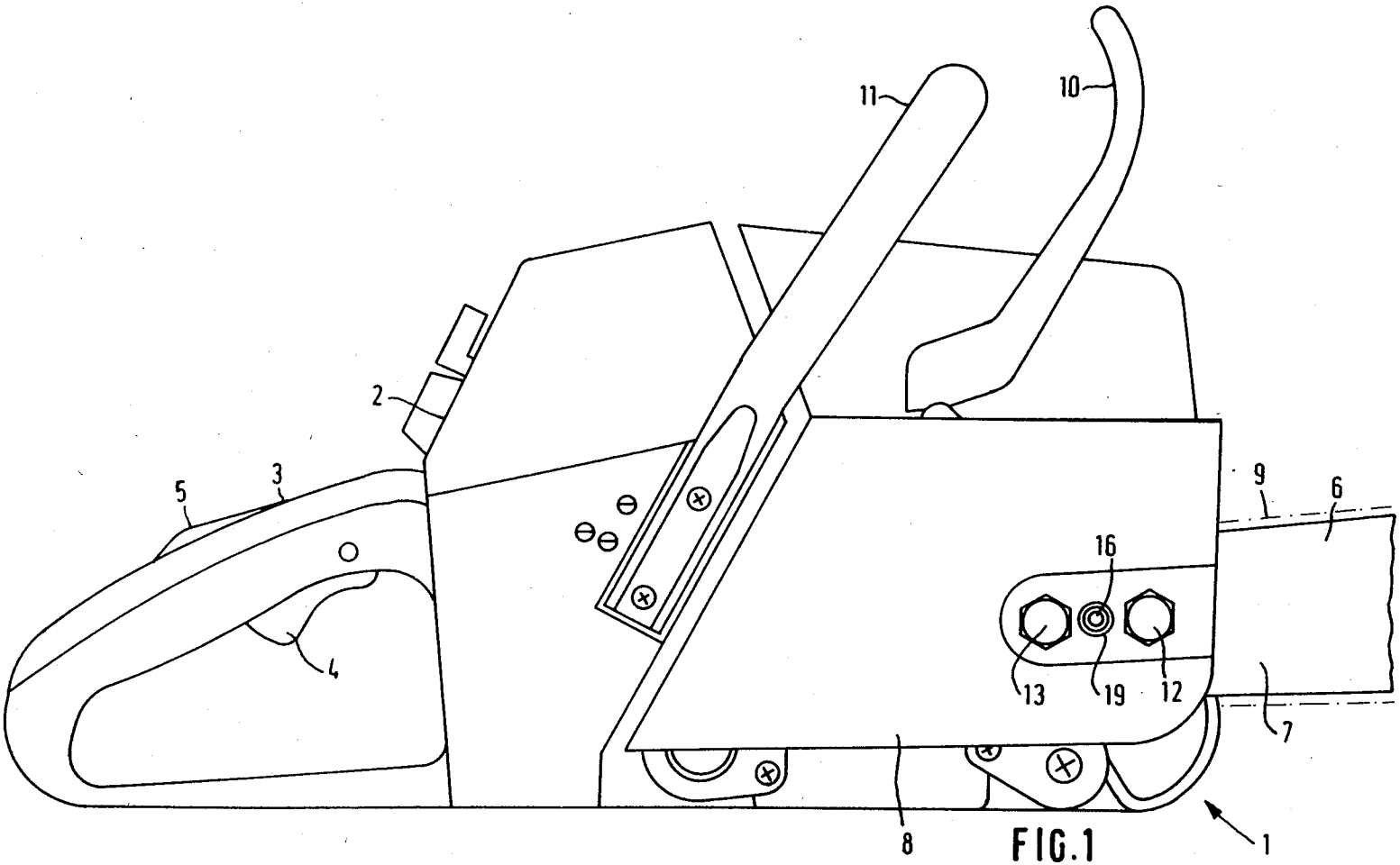
FIG. 1 is a side elevation view of a chain saw having a tensioning device according to the invention.

Referring to FIG. 1, reference numeral 1 designates the motor housing wherein a drive motor such as, for example, an internal combustion engine (not shown) is mounted. A rearward handle 3 is secured to the rearward end 2 of the housing 1 and extends rearwardly in the longitudinal direction of the housing. The control elements of the internal combustion engine are mounted in the handle 3 and are indicated by reference numerals 4 and 5. The rearward end 7 of the cutter bar 6 is mounted in the housing 1 as also shown in FIG. 1. The cutter bar 6 is held sandwiched between two side plates **7*a* and 7*b* (FIG. 3) and is clamped in position between the motor housing and a sprocket wheel cover 8. A saw chain 9 is schematically illustrated in FIG. 1 and is mounted on the cutter bar 6 and on a sprocket wheel (not shown in FIG. 1) arranged behind and in spaced relation to the rearward end 7 of the cutter bar. A pivotable guard lever 10 is mounted in the motor housing transverse to the cutter bar 6 and transverse to the rearward handle 3. A forward handle 11 is mounted on the housing behind and in spaced relationship to the guard lever 10. The guard lever 10** acts to prevent a kickback of the chain saw during cutting operations and is connected to a braking arrangement (not shown) which becomes active when an accelerated movement occurs as a consequence of the kickback action and when this accelerated movement exceeds a predetermined amount.

Figure 2:
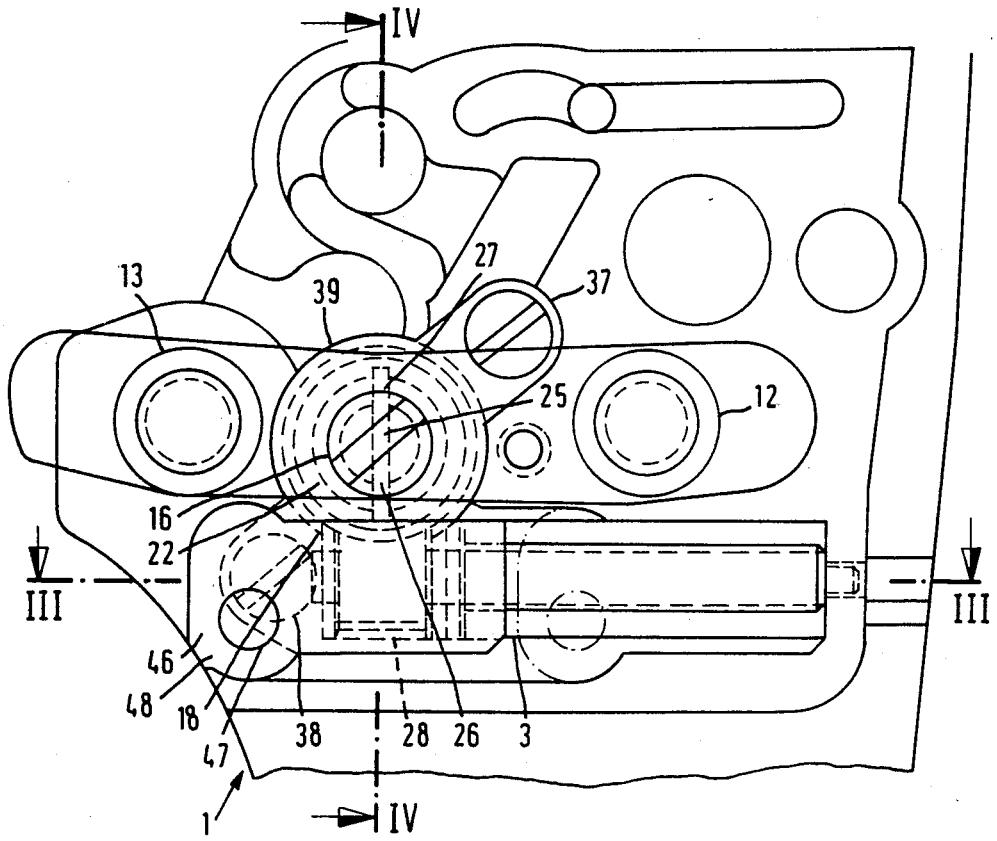
FIG. 2 is a side elevation view of a portion of the chain saw of FIG. 1 without the cutter bar and where the sprocket wheel cover has been removed to show the tensioning arrangement of the invention.

The housing 1 is provided with two threaded bolts 12 and 13 as shown in FIG. 2 which are spaced one behind the other in the longitudinal direction of the chain saw onto which the cutter bar 6 and the sprocket wheel cover 8 are securely mounted. The cutter bar 6 is displaceably guided on the threaded bolts 12 and 13 in the direction of its longitudinal axis and is held against tilting. The rearward end 7 of the cutter bar 6 is provided with an elongated opening 14 (FIG. 4) for mounting the cutter bar 6 on the bolts 12 and 13. The elongated opening 14 extends over substantially the entire length of the rearward end 7 of the cutter bar 6. The bolts 12 and 13 are disposed at a relatively large spacing from each other and extend transversely to the longitudinal direction of the cutter bar 6 and are disposed in the elongated slot 14 so as to be substantially free of play thereby securing the cutter bar 6 against tilting A tensioning arrangement is accommodated in the housing 1 for tensioning the saw chain. The tensioning arrangement includes a drive member 16 and an output member 17 which are operatively connected by a transmission 18.

The drive member 16 can be in the form of a tensioning bolt which is arranged between the bolts 12 and 13 and projects into a corresponding opening in the housing. The tensioning bolt 16 projects through the elongated opening 14 of the cutter bar 6 as do the bolts 12 and 13. The tensioning bolt 16 also projects through a cover opening 19 (FIG. 4) aligned with the housing opening when the sprocket wheel cover is mounted onto the housing. A head 20 of the tensioning bolt 16 is arranged so as to be recessed in the cover opening 19 to protect the same against damage. The head 20 of the bolt 16 has a slot 21 for receiving a screwdriver.

The tensioning bolt 16 carries a gear wheel configured as a helical gear 22 and the helical gear wheel is supported with respect to the housing 1 by means of a spring washer 23.

Figure 4:
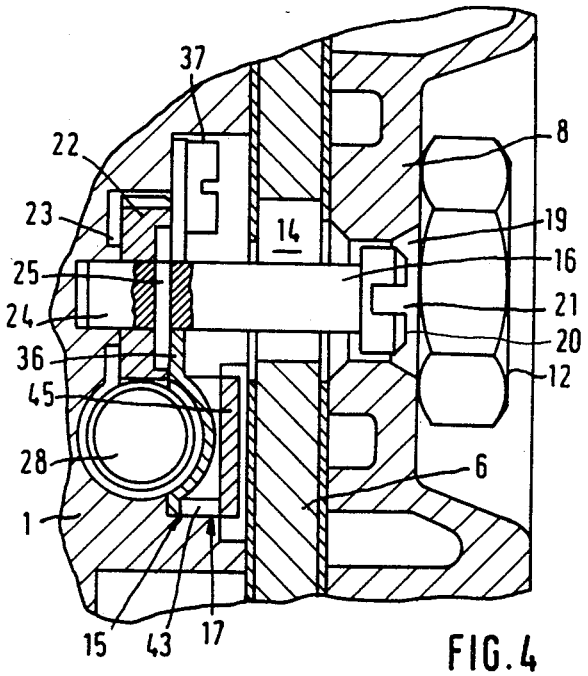
FIG. 4 is a section view taken along line IV—IV of FIG. 2.

A transverse bore at the end 24 of the tension bolt 16 accommodates an overload pin 25 for limiting torque. The overload pin 25 has projecting ends 26 and 27 which are held in a form-tight manner in radial slots on the side of the helical gear wheel 22 facing away from the housing 1 (FIGS. 2 and 4). The overload pin 25 will plastically deform as a consequence of an excessive torque applied when the saw chain is over-tensioned. In this way, damage to the gearing is prevented, especially when the gears are made of plastic. Preferably, the overload pin 25 can be bent back into its undeformed position.

The helical gear wheel 22 can be configured as a single piece with the tensioning bolt 16 for the purpose of simplifying and making manufacture thereof inexpensive.

The helical gear wheel 22 meshes with a second gear wheel 28 which is likewise configured as a helical gear wheel. A positioning spindle 30 has a threaded portion and an end portion 29 without a thread formed thereon whereat the helical gear wheel 28 is fixedly attached. The positioning spindle 30 can likewise be configured with the helical gear wheel 28 as a single piece in order to simplify the manufacture and assembly of the tensioning arrangement of the invention. The helical gear wheels 22 and 28 and the positioning spindle 30 conjointly make up the transmission 18.

The second helical gear wheel 28 and the positioning spindle 30 lie beneath the tensioning bolt 16. The positioning spindle 30 extends parallel to the elongated opening 14 and the cutter bar 6. The positioning spindle 30 is further journaled in bearing openings 33 and 34 of the housing with its end portions 31 and 32, respectively. The end portion 31 projects beyond the helical gear wheel 28 and the end portion 32 is narrowed and is disposed at the other end of the positioning spindle 30 as shown. The one bearing opening 33 corresponding to end portion 31 is formed on the side 35 facing the cutter bar 6 of a cover configured as a bearing shield 36; whereas, the other bearing opening 34 is in the form of a through bore. The bearing shield 36 is secured to the housing 1 by screws 37 and 38 which are arranged at different sides of the tensioning bolt 16 as shown in FIGS. 2 and 4. The bearing shield 36 lies flat against the housing in the area of the -screws 37 and 38 and is adapted to the form of the helical gear 28 at the region thereof. Furthermore, the bearing shield 36 covers the first helical gear wheel 22 and the overload pin 25. The overload pin 25 and helical gear 22 lie with their surfaces that face away from the housing against portion 39 of the bearing shield 36. This portion 39 of the bearing shield 36 is partially circular in configuration. The circular portion 39 of the bearing shield includes a pass-through opening for the tensioning bolt 16. With the bearing shield 36, all other parts of the tensioning arrangement 15 including the output member 17 are prevented from falling out when the tensioning arrangement is utilized by the operator.

The parts 16, 22, 28 and 30 of the tensioning arrangement can be built into a separate housing. This preassembled component can then be secured in housing 1 simply and in the shortest time in a single assembly step.

The positioning spindle 30 has a portion 42 on which a thread is formed. The output member 17 is mounted on this threaded portion 42 and is configured as an L-shaped slider as shown in longitudinal section in FIG. 3. The L-shaped slider 17 has a short leg 43 that includes a threaded bore for threadably engaging the positioning spindle 30. The thickness of the short leg 43 is approximately twice as large as the thickness of the long leg 45 of the slider 17 whereby the short leg has a high resistance to bending so that the slider will not tilt with respect to the positioning spindle 30 and therefore can be easily displaced thereon.

The long leg 45 extends parallel to the cutter bar 6 and has an end portion 46 that widens in a direction transverse to the longitudinal axis of the cutter bar 6 as shown in FIG. 2. On this widened end portion 46, the slider 17 carries entrainment means in the form of a take-along bolt 47. The take-along bolt 47 is mounted at the free end 46 of the leg 45 and projects beyond the outer surface 48 facing away from the housing 1 and projects into a bearing opening 49 of the cutter bar 6 (FIGS. 2 and 3) adapted to accommodate the same.

In lieu of the take-along bolt 47, the slider 17 can have a pin or projection which is bent out or drawn out from the long leg 45. Such a projection is configured so that its greatest resisting moment acts in the direction in which the slider 17 is displaced.

The tensioning arrangement 15 can be simplified if, in lieu of the tensioning bolt 16, a housing pin (not illustrated) is provided that is configured as a single assembly with the housing and upon which a spur gear is mounted. The substitute pin could have an axially extending appendage which projects through the elongated opening 14 and through the cover opening 19. The appendage could then have a slot for accommodating a screwdriver.

In order to protect the region of the screwdriver slot of the tensioning bolt 16 from wear, a form-fitting cap made of metal can be placed over the head 20 of the bolt and have a slot formed therein for receiving a screwdriver.

To adjust the tension of the saw chain, a screwdriver is inserted into the slot 21 of the tensioning bolt 16 from the outside of the housing. The screwdriver and bolt 16 are then preferably rotated in the clockwise direction. The tensioning bolt 16 is arranged so as to be easily seen from the outside of the housing so that a screwdriver can be easily and quickly inserted into the slot 21 and can without hindrance be rotated through the cutter bar 6 or the housing 1.

As the tensioning bolt 16 is rotated, the helical gear wheel 22 mounted thereon is also rotated. The second helical gear wheel 28 meshes with the helical gear wheel 22 so that the positioning spindle 30 is rotated and therefore the slider 17 mounted on the latter is displaceable in the direction of the arrow P shown in FIG. 3. The cutter bar 6 is displaced with the slider 17 via the take-along bolt 47 so that the cutter bar 6 is displaced away from the sprocket wheel whereby the saw chain 9 is tensioned.

Figure 3:
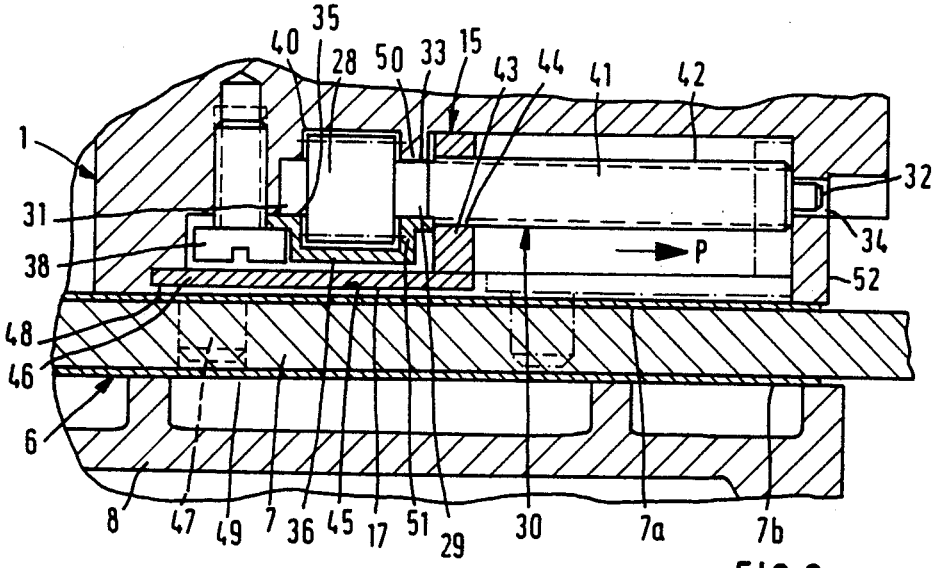
FIG. 3 is a section view taken along line III—III of FIG. 2.

The solid line in FIG. 3 shows the starting position of the slider 17 whereat the short leg 43 lies on an abutment 50 formed on the housing and on an L-shaped edge 51 of the bearing shield 36 which is bent outwardly; whereas, the short leg 43 lies against the wall 52 having the through bore 34 when the saw chain is tensioned to the maximum. This latter position of the slider 17 is shown by a broken line in FIG. 3.

By configuring the output member as an L-shaped slider 17, it is assured that the tensioning arrangement 15 can be utilized with conventional and standard cutter bars so that substantial production costs for a costly retrofit are avoided. In addition, it is not necessary to manufacture a new cutter bar for accommodating the tensioning arrangement of the invention and this too avoids substantial production cost. Because of the axial displacement in position of the take-along bolt 47 vis-a-vis the short leg 43, the take-along bolt 47 can be inserted into the already available elongated opening of the cutter bar 6 and be displaced unimpeded along the threaded portion 42 of the transmission 18.

It is understood that the foregoing description is that of the preferred embodiments of the invention and that various changes and modifications may be made thereto without departing from the spirit and scope of the invention as defined in the appended claims.

What is claimed is:

1. An arrangement for tensioning the saw chain of a power-driven chain saw having a motor housing and a cutter bar for guiding the saw chain, the cutter bar having two flat sides, one of the flat sides facing toward the housing and the other one of the flat sides facing away from the housing, the cutter bar defining a longitudinal axis and having an elongated opening extending substantially in the direction of said axis, the chain saw further having a sprocket wheel for moving the saw chain about the periphery of the cutter bar and a sprocket wheel cover mounted next to said other one of the flat sides of said cutter bar facing away from the housing; the arrangement comprising:

a pair of guide members extending from said housing and engaging said cutter bar in said elongated opening for mounting the same on said housing so as to permit a displacement of the cutter bar with respect thereto in the direction of said axis;

said housing having a recess formed therein directly next to said one side of said cutter bar, said one side and said recess conjointly defining an enclosed compartment communicating with said elongated opening;

drive means mounted in said compartment and located between the guide members so as to be conventiently accessible from said other side through said elongated opening irrespective of the presence of said sprocket wheel cover;

output means mounted in said compartment and arranged adjacent said cutter bar;

transmission means mounted in said compartment for connecting said drive means to said output means so as to actuate the latter in response to a movement of said drive means; and, entrainment means also mounted in said compartment for interconnecting said output means with said cutter bar for entraining and moving said cutter bar in the direction of said axis away from said sprocket wheel to increase the tension in said saw chain in response to an adjustment of said drive means.

2. The arrangement of claim 1, said output means including: a slider mounted so as to be movable in the direction of said axis; and, translation means connected to said transmission means for imparting a linear movement to said slider in said direction; and, said entrainment means includes a take-along projection on said slider for engaging said elongated opening and entraining said cutter bar for moving the latter in said direction.

3. The arrangement of claim 2, said translation means including a threaded positioning spindle connected to said transmission means; said slider having an L-shaped configuration with one leg thereof extending transversely to said positioning spindle, the other leg thereof extending in a direction away from said one leg; said translation means further including a threaded bore formed in said one leg for threadably engaging said positioning spindle whereby a rotation of said positioning spindle causes a linear movement of said slider.

4. The arrangement of claim 3, said take-along projection being mounted on the end of said other leg remote from said one leg.

5. The arrangement of claim 4, said one leg extending in a direction opposite to said take-along projection.

6. The arrangement of claim 3, said drive means including a drive shaft rotatably mounted with respect to said motor housing;

said transmission means including: a first gear mounted on said drive shaft; and, a second gear mounted on said positioning spindle and being in meshed engagement with said first gear whereby a rotation of said drive shaft causes a rotation of said positioning spindle.

7. The arrangement of claim 6, said drive means including: overload means for protecting said gears of said transmission means from an excessive torque applied to said drive shaft.

8. The arrangement of claim 7, said overload means including a transverse bore formed in said drive shaft and a deformable pin mounted in said transverse bore; said pin engaging said first gear and being made of a material which deforms when the torque transmitted from said drive shaft to said first gear is greater than a predetermined amount.

9. The arrangement of claim 8, said first gear having a recess formed therein for accommodating said pin in a form-tight manner.

10. The arrangement of claim 9, wherein, gear and said pin are disposed behind said cover such that said first gear lies directly on the inside wall surface of said sprocket wheel cover so as to cause said wall surface to hold said pin in position in said recess.

11. An arrangement for tensioning the saw chain of a power-driven chain saw having a motor housing and a cutter bar for guiding the saw chain, the cutter bar having two flat sides, one of the flat sides facing toward the housing and the other one of the flat sides facing away from the housing, the cutter bar defining a longitudinal axis and having an elongated opening extending substantially in the direction of said axis, the chain saw further having a sprocket wheel for moving the saw chain about the periphery of the cutter bar and a sprocket wheel cover mounted next to said other one of the flat sides of said cutter bar facing away from the housing; the arrangement comprising:

a pair of guide members extending from said housing and engaging said cutter bar in said elongated opening for mounting the same on said housing so as to permit a displacement of the cutter bar with respect thereto in the direction of said axis;

said housing having a recess formed therein directly next to said one side of said cutter bar, said one side and said recess conjointly defining an enclosed compartment communicating with said elongated opening;

a drive member mounted in said compartment and being disposed between said guide members so as to be conveniently accessible for adjustment from said other side of said cutter bar irrespective of the presence of said sprocket wheel cover;

an output member operatively connected to said cutter bar for displacing the latter in the longitudinal direction thereof, said output member being disposed between said one side and said housing; and, transmission means for connecting said drive member to said output member so as to move the latter when adjusting said drive member thereby displacing the cutter bar along said projection means in a direction away from said sprocket drive wheel and increasing the tension in said saw chain, said transmission means being rotatably journalled in said housing directly adjacent said one side of said cutter bar whereby the entire arrangement is disposed between said one side of the cutter bar and the housing.

12. The arrangement of claim 11 wherein said drive member is configured so as to also extend through said elongated opening; and the arrangement further comprising: entrainment means interconnecting said output means with said cutter bar for entraining and moving said cutter bar in the direction of said axis away from said sprocket wheel to increase the tension in said saw chain in response to an adjustment of said drive member.

* * * * *

UNITED STATES PATENT AND TRADEMARK OFFICE

CERTIFICATE OF CORRECTION

PATENT NO. : 4,567,658

DATED : February 4, 1986

INVENTOR(S) : Michael Wissmann, Hans Nickel & Erich Zöllner

It is certified that error appears in the above-identified patent and that said Letters Patent is hereby corrected as shown below:

In column 4, line 5: delete "-screws" and substitute -- screws -- therefor.

In column 5, line 67: delete "the" and substitute -- said -- therefor.

In column 5, line 68: delete "conventiently" and substitute -- conveniently -- therefor.

In column 6, line 64: after "wherein," add -- said first -- .

Signed and Sealed this

*Twenty-ninth* Day of *July 1986*

[SEAL]

*Attest:*

DONALD J. QUIGG

*Attesting Officer*

*Commissioner of Patents and Trademarks*